US009179754B2

(12) United States Patent
Han

(10) Patent No.: US 9,179,754 B2
(45) **Date of Patent: *Nov. 10, 2015**

(54) ARTIFICIAL NAIL OR TIP ARRANGEMENT AND METHOD OF MAKING SAME

(71) Applicant: Kiss Nail Products, Inc., Port Washington, NY (US)

(72) Inventor: Kyusang Han, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/030,576

(22) Filed: Sep. 18, 2013

(65) Prior Publication Data

US 2014/0090657 A1 Apr. 3, 2014

Related U.S. Application Data

(63) Continuation of application No. 13/024,096, filed on Feb. 9, 2011, now Pat. No. 8,561,619, which is a continuation-in-part of application No. 12/632,980, filed on Dec. 8, 2009, now abandoned.

(51) Int. Cl.

| | |
|---|---|
| ***A45D 24/00*** | (2006.01) |
| ***A45D 29/00*** | (2006.01) |
| ***A45D 31/00*** | (2006.01) |

(52) U.S. Cl.

CPC ..... *A45D 31/00* (2013.01); *A45D 29/001* (2013.01); *Y10T 428/1471* (2015.01); *Y10T 428/1476* (2015.01)

(58) Field of Classification Search

CPC ..... A45D 29/001; A45D 2029/002; A45D 31/00; A45D 2031/005; A45D 29/00; A45D 29/18; Y10T 428/1471; Y10T 428/1476; Y10T 428/1486; A61F 13/02; A61F 13/10; A61F 13/024; A61F 13/104; A61F 13/105; A61F 13/0259; A61F 2013/008; A61F 2013/00817; A61F 2013/00821; A61K 9/703

USPC ..... 132/73, 200, 73.5, 285, 317, 319, 320, 132/333; 428/40.1, 41.7, 41.8, 42.2, 42.3, 428/43, 15; 156/61, 212, 242, 245, 246, 156/247, 250, 285, 289, 257, 259; 604/389, 604/390, 344; 602/57, 58, 54

See application file for complete search history.

(56) References Cited

U.S. PATENT DOCUMENTS

| | | | |
|---|---|---|---|
| 2,979,061 | A | 4/1961 | Greenman et al. |
| 3,023,887 | A | 3/1962 | Cohen |

(Continued)

FOREIGN PATENT DOCUMENTS

| | | |
|---|---|---|
| JP | 0611605 | 2/1994 |
| JP | 7-21748 | 4/1995 |

(Continued)

OTHER PUBLICATIONS

Litigation Case Captioned Kiss Nail Products, Inc. v. *Tianjin Shuangrong Paper Products Co., Ltd. and Shuang Rong America, LLC*, filed on Jul. 31, 2015 in the United States District Court Southern District of New York, Case 1:15-cv-06019.

*Primary Examiner* — Vanitha Elgart

(74) *Attorney, Agent, or Firm* — K&L Gates LLP

(57) ABSTRACT

In some aspects, an artificial nail or tip arrangement can include a body having a concave lower surface with a shape corresponding to a natural nail; an adhesive layer having a first surface to adhere to a portion of the lower surface of the body and a second surface to adhere to a portion of the natural nail; and a removable layer that covers a portion of the second surface of the adhesive layer, the removable layer having at least one slit formed therethrough and disposed along a planar surface of the removable layer, wherein the at least one slit is configured to facilitate conformance of the planar surface of the removable layer to the concave lower surface of the body without wrinkling the removable layer.

16 Claims, 6 Drawing Sheets

(56) References Cited

U.S. PATENT DOCUMENTS

| | | | | |
|---|---|---|---|---|
| 3,880,159 | A | 4/1975 | Diamond | |
| 4,255,220 | A | 3/1981 | Kucheck et al. | |
| 4,511,608 | A | 4/1985 | Ferraro | |
| 4,524,095 | A | 6/1985 | Gockel et al. | |
| 4,526,648 | A | 7/1985 | Tochtermann | |
| 4,536,426 | A | 8/1985 | Massey | |
| 4,587,146 | A | 5/1986 | Anhauser et al. | |
| 4,614,183 | A | 9/1986 | McCracken et al. | |
| 4,745,934 | A | 5/1988 | Mast et al. | |
| 4,824,702 | A | 4/1989 | Straub | |
| 4,860,774 | A | 8/1989 | Becker | |
| 4,876,121 | A | 10/1989 | Cohen | |
| 4,903,840 | A | 2/1990 | So | |
| 4,947,876 | A | 8/1990 | Larsen | |
| 5,005,595 | A | 4/1991 | Aylott | |
| 5,008,110 | A | 4/1991 | Benecke et al. | |
| 5,044,384 | A | 9/1991 | Hokama et al. | |
| 5,266,371 | A | 11/1993 | Sugii et al. | |
| 5,279,690 | A | 1/1994 | Hess et al. | |
| 5,415,903 | A | 5/1995 | Hoffman et al. | |
| 5,450,864 | A | 9/1995 | LaJoie et al. | |
| 5,525,389 | A | 6/1996 | Hoffmann et al. | |
| 5,705,021 | A | 1/1998 | Wurz et al. | |
| 5,720,499 | A | 2/1998 | Sakashita | |
| 5,800,894 | A | 9/1998 | Navis | |
| 5,853,530 | A | 12/1998 | Allen | |
| 5,868,727 | A | 2/1999 | Barr et al. | |
| 5,914,165 | A | 6/1999 | Freedman | |
| 5,998,694 | A | 12/1999 | Jensen et al. | |
| 6,001,441 | A | 12/1999 | Polizzano | |
| 6,042,679 | A | 3/2000 | Holt et al. | |
| 6,062,235 | A | 5/2000 | Renna | |
| 6,096,942 | A | 8/2000 | Hack | |
| 6,277,458 | B1 | 8/2001 | Dirksing et al. | |
| 6,297,422 | B1 | 10/2001 | Hansen et al. | |
| 6,357,451 | B1 | 3/2002 | Carter | |
| 6,378,590 | B1 | 4/2002 | Allen et al. | |
| 6,394,100 | B1 | 5/2002 | Chang | |
| 6,841,716 | B1 | 1/2005 | Tsutsumi | |
| 6,941,954 | B1 | 9/2005 | Belcher | |
| 7,185,660 | B1 | 3/2007 | Han | |
| 7,306,837 | B2 | 12/2007 | Hagen et al. | |
| 7,709,070 | B2 * | 5/2010 | Kinsey et al. | 428/40.1 |
| 7,824,753 | B2 | 11/2010 | Bartusiak | |
| 7,888,546 | B2 | 2/2011 | Marcoux et al. | |
| 7,910,792 | B2 | 3/2011 | Iwahashi et al. | |
| 7,921,999 | B1 * | 4/2011 | Kimball | 206/440 |
| 8,118,039 | B2 * | 2/2012 | Chang | 132/285 |
| 8,216,653 | B2 | 7/2012 | Liao et al. | |
| 8,528,570 | B2 * | 9/2013 | Chang | 132/73 |
| 2002/0011304 | A1 | 1/2002 | Abron | |
| 2003/0138479 | A1 * | 7/2003 | Mizota et al. | 424/443 |
| 2004/0138603 | A1 | 7/2004 | Cleary et al. | |
| 2005/0214495 | A1 | 9/2005 | Thiebaut | |
| 2005/0217686 | A1 | 10/2005 | Lee | |
| 2005/0256439 | A1 | 11/2005 | Grossman | |
| 2006/0003133 | A1 | 1/2006 | Johnson | |
| 2006/0124237 | A1 | 6/2006 | Nordin et al. | |
| 2007/0107745 | A1 | 5/2007 | Kiyomoto | |
| 2007/0212509 | A1 * | 9/2007 | Herbig et al. | 428/40.1 |
| 2008/0283076 | A1 | 11/2008 | Fracassi et al. | |
| 2008/0286517 | A1 | 11/2008 | Zickell et al. | |
| 2009/0004422 | A1 | 1/2009 | Bartusiak | |
| 2009/0230011 | A1 | 9/2009 | Park | |
| 2010/0224312 | A1 | 9/2010 | Tsubaki et al. | |
| 2011/0030711 | A1 | 2/2011 | Han | |
| 2011/0114106 | A1 | 5/2011 | Munoz | |
| 2011/0146893 | A1 | 6/2011 | Marty et al. | |
| 2011/0208103 | A1 | 8/2011 | Leschinsky | |
| 2013/0059104 | A1 * | 3/2013 | Chang | 428/41.8 |
| 2013/0289465 | A1 * | 10/2013 | Hohnbaum | 602/57 |

FOREIGN PATENT DOCUMENTS

| | | |
|---|---|---|
| JP | 2002-321293 | 11/2002 |
| JP | 3110401 | 6/2005 |
| KR | 1020060091440 | 8/2006 |
| TW | M347925 | 1/2009 |
| TW | M355926 | 5/2009 |
| TW | M385968 | 8/2010 |

* cited by examiner

ARTIFICIAL NAIL OR TIP ARRANGEMENT AND METHOD OF MAKING SAME

CROSS-REFERENCE TO RELATED APPLICATIONS

This application is a Continuation Application of U.S. patent application Ser. No. 13/024,096, filed on Feb. 9, 2011, which is a Continuation-In-Part Application of U.S. patent application Ser. No. 12/632,980, filed Dec. 8, 2009, the contents of which are incorporated herein by reference.

BACKGROUND

1. Field of the Invention

The present invention relates generally to artificial nails (e.g., finger nails or toe nails), nail extensions, tips, etc., and more particularly, to a pre-taped artificial nail having an adhesive with a removable protective layer, and a method of making the same.

2. Description of Related Art

Ornamental fingernail accessories made from thin, molded plastic members manufactured generally in the shape of a fingernail are commonly known in the art. (See, e.g. U.S. Pat. No. 6,394,100 issued to Chang). Typically, the user applies a small amount of a liquid bonding adhesive to the fingernail accessory or the natural nail and affixes the fingernail accessory to the nail. As an alternative, U.S. Pat. No. 4,745,934 issued to Mast et al., provides an adhesive press-on tab system for attaching artificial fingernails to the user's natural nails. The tabs are essentially double-sided adhesive tape with removable layers that are interposed between the artificial fingernail and the natural fingernail.

Attempts have been made to provide an ornamental fingernail having a pre-applied pressure sensitive layer with varying degrees of success. For example, U.S. Pat. No. 5,415,903 issued to Hoffman et al. describes a self-adhesive laminate having an adhesive composition made of an acrylic copolymer requiring acrylic acid and titanium chelate ester. U.S. Pat. No. 6,042,679 issued to Holt et al. describes that an acrylic pressure sensitive adhesive known in the art can be used in a method for treating damaged fingernails. U.S. Pat. No. 5,044,384 issued to Hokama et al. describes that a pressure-sensitive adhesive known in the art can be used in a method for accomplishing a rapid and durable manicure. U.S. Pat. No. 4,860,774 issued to Becker describes that a commercially available pressure-sensitive adhesive can be used in a method for fingernail reinforcement.

U.S. Pat. No. 7,185,660 to Han describes an artificial fingernail and method of making an artificial fingernail in which the artificial fingernail is pre-taped with an adhesive layer covered by a removable layer during the manufacturing process. The removable layer covers the adhesive layer and is removable to expose the adhesive layer for application to the natural fingernail.

However, during manufacture, when the adhesive layer is pushed to contact and adhere to a concave lower surface of the artificial fingernail, a crease or wrinkle can form in the removable layer resulting in a less desirable product with compromised adhesive properties.

SUMMARY OF INVENTION

The present invention has been made to address at least the above problems and/or disadvantages and to provide at least the advantages described below. Accordingly, an aspect of the present invention provides an artificial nail or tip arrangement having slits cut from a removable layer covering an adhesive layer.

According to one aspect of the present invention, an artificial nail or tip arrangement is provided that includes a body having a concave lower surface with a shape corresponding to a shape of at least one portion of a natural nail. The artificial nail or tip arrangement also includes an adhesive layer having a first surface and an opposing second surface. The first surface adheres to at least one portion of the concave lower surface of the body and the second surface is provided to adhere to the at least one portion of the natural nail when applied thereto. The artificial nail or tip arrangement further includes a removable layer that covers at least one portion of the second surface of the adhesive layer, and which is removable to expose the at least one portion of the second surface of the adhesive layer for application to the at least one portion of the natural nail. The removable layer includes at least one slit formed therethrough and disposed along a planar surface of the removable layer. The at least one slit is disposed entirely within a periphery of the removable layer. The at least one slit is configured to facilitate conformance of the planar surface of the removable layer to the concave lower surface of the body without wrinkling the removable layer after adherence of the first surface of the adhesive layer with the concave lower surface of the body.

According to another aspect of the present invention a method of making an artificial nail or a nail tip is provided. A body is provided having a shape corresponding to at least one portion of the artificial nail or the nail tip, a convex surface and a concave surface. A composite strip is disposed over the body. The composite strip comprises an a removable layer and an adhesive layer having a first surface and second surface, the first surface faces the concave surface of the body, and the second surface is covered by the removable layer. At least one slit is formed in the removable layer. The at least one slit is disposed entirely within a periphery of the removable layer. A pressure is applied to the composite strip so as to adhere at least one portion of the adhesive layer to the concave surface of the body. The application of the pressure to the portion of the composite strip, which adhered to the concave surface of the body, is reduced or eliminated. The at least one slit is configured to facilitate conformance of the planar surface of the removable layer to the concave surface of the body without wrinkling the removable layer after adherence of the composite strip to the concave surface of the body.

According to an additional aspect of the present invention, an artificial nail or tip arrangement is provided including a body having a concave lower surface with a shape corresponding to a shape of at least one portion of a natural nail. The artificial nail or tip arrangement also includes an adhesive layer having a first surface and an opposing second surface. The first surface adheres to at least one portion of the concave lower surface of the body and the second surface is provided to adhere to the at least one portion of the natural nail when applied thereto. The artificial nail or tip arrangement further includes a removable layer that covers at least one portion of the second surface of the adhesive layer, and which is removable to expose the at least one portion of the second surface of the adhesive layer for application to the at least one portion of the natural nail. The removable layer includes at least one tab that extends outwardly outside a periphery of the body, and at least one slit formed therethrough and disposed along a planar surface of the removable layer, the at least one slit being disposed entirely within a periphery of the removable layer. The at least one slit is configured to facilitate conformance of the planar surface of the removable layer to the concave lower surface of the body without wrinkling the removable layer after adherence of the first surface of the adhesive layer with the concave lower surface of the body.

According to a further aspect of the present invention, an artificial nail or tip arrangement is provided that includes a body having a concave lower surface with a shape corresponding to a shape of at least one portion of a natural nail. The body has a cuticle end for application proximate to the cuticle of the natural nail and a nail tip end opposite the cuticle end. The artificial nail or tip arrangement also includes an adhesive layer having a first surface and an opposing second surface. The first surface adheres to a first portion of the concave lower surface of the body and the second surface is provided to adhere to the at least one portion of the natural nail when applied thereto. The artificial nail or tip arrangement further includes a removable layer that covers the second surface of the adhesive layer, and which is removable to expose the second surface of the adhesive layer for application to the at least one portion of the natural nail. The removable layer includes a tab that extends outwardly beyond a periphery of the body and the adhesive layer, and a plurality of slits formed therethrough and disposed along a planar surface of the removable layer. At least two of the plurality of slits are formed at angles with respect to a longitudinal axis of the body. The angles of the at least two of the plurality of slits are different from each other. The plurality of slits are configured to facilitate conformance of the planar surface of the removable layer to the concave lower surface of the body without wrinkling the removable layer after adherence of the first surface of the adhesive layer with the concave lower surface of the body.

BRIEF DESCRIPTION OF THE DRAWINGS

The above and other aspects, features and advantages of the present invention will be more apparent from the following description when taken in conjunction with the accompanying drawings, in which.

DETAILED DESCRIPTION OF EMBODIMENTS OF THE PRESENT INVENTION

Figure 1:
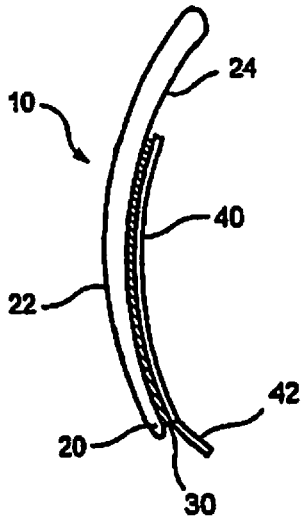
FIG. 1 illustrates a first embodiment of an artificial fingernail of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Figure 2:
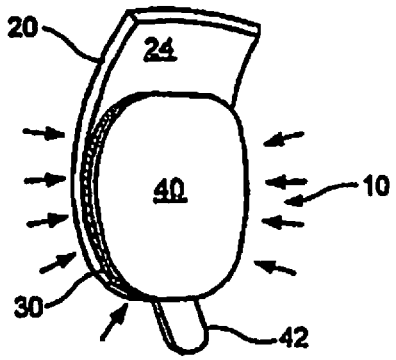
FIG. 2 is a bottom perspective view according to the first embodiment of the present invention in FIG. 1.

FIGS. 1 and 2 show an artificial fingernail 10 according to a first embodiment of the present invention. The term "artificial fingernail" can include, but is not limited to, a full-cover nail intended to be applied over the entire surface of a user's natural nail (e.g., a finger nail or a toe nail), a nail extension or "nail tip" intended to be applied to at least one portion of the user's natural nail, and the like.

As shown in FIGS. 1 and 2, the artificial nail 10 may include a polymeric body 20 corresponding to a shape of at least one portion of a natural fingernail. The polymeric body 20 can be designed as a full-cover nail, a partial artificial nail portion and/or an artificial nail tip. The polymeric body 20 can be made from a composition of Acrylonitrile-Butadiene-Styrene (ABS) plastic and a polycarbonate. Further, the polymeric body 20 can also be made from any plastic-like material commonly employed in the manufacture of artificial nails, such as ABS plastic, nylon, tenite acetate, vinyl acetate, polycarbonates, polyvinyl chloride, etc.

Examples of suitable hard materials for the polymeric body 20 can include Styrolux® 684D (SBC), a styrene-butadiene block copolymer available from BASF Corporation; Cyro® R40 (acrylic base), an acrylic-based multipolymer available from Cyro Industries of Rockaway, N.J.; Lexane KR01 (PC) (trade name), a polycarbonate available from GE Plastics; K-Resin® (SBC), a styrene-butadiene copolymer available from Chevron Phillips Chemical Company; TP-UXS (MMBS) (trade name), a methyl methacrylate butadiene styrene terpolymer available from DENKA of Tokyo, Japan; Starex® 5010 (ABS), an acrylonitrile butadiene styrene available from Samsung Cheil Industries; Zylar® 220 (SMMC) and Nas® 30, styrene methyl methacrylate copolymers available from Nova Chemicals; and Toyalac 920 (Clear ABS), an acryloritrile butadiene styrene available from Toray Resin Company.

The polymeric body 20 preferably has a thickness of between about 0.35 and 0.65 mm, but the thickness may vary according to the application. The polymeric body 20 can include an upper surface 22, which is provided to be away from a surface of the user's natural nail, and a lower surface 24, which is structured to face a top surface of the user's natural nail. An adhesive layer 30 can be secured to at least one portion of the lower surface 24, preferably a proximal portion of lower surface 24 which is intended to be closer to a cuticle of the user's natural nail. The adhesive layer 30 is configured to adhere to an upper surface of the user's natural nail when applied thereto. The adhesive layer 30 can include, e.g., a copolymer of acrylic ester and vinyl acetate formed from an aqueous acrylic copolymer emulsion that has been dried on a carrier film.

A removable layer 40 can be provided on, and cover, the adhesive layer 30. The removable layer 40 can be removed from the adhesive layer 30 to expose adhesive layer 30 for application to the user's natural fingernail. In particular, according to the first embodiment of the present invention, the removable layer 40 includes a tab 42 for facilitating removal of the layer 40 from the adhesive layer 30 extending outwardly beyond the periphery of the polymeric body 20. According to this embodiment and as shown in FIGS. 1 and 2, the tab 42 can be integrally and/or detachably connected to a front edge of the layer 40, e.g., at a front edge of the polymeric body 20 that is provided for application at or close to a cuticle of the user's natural nail.

Due to the positioning of the tab 42 beyond the periphery of the polymeric body 20 and/or the artificial nail 10, it is easier and quicker for the user to remove the removable layer 40 from the adhesive layer 30 that is provided on the polymeric body 20. This is because there is a structure to allow the user to grasp the tab 42 of the removable layer 40 to remove it from the adhesive layer 30. In addition, it is possible to bend the tab 42 to be initially situated under the lower surface 24 when it is packaged. This configuration (i.e., bending) of the tab 42 can facilitate an easier packaging of the artificial nail 10 (or tip/extension), and possibly reduce and/or prevent damage or unintended removal of the tab 42. When the user or anyone else is prepared to remove the removable layer 40, the tab 42 can be unbent such that it extends beyond the periphery of the polymeric body 20.

The adhesive layer 30 can include a film including a pressure sensitive adhesive, and the removable layer 40 can include a silicon treated paper or plastic film. According to one embodiment of the present invention, the adhesive layer 30 is preferably an unsupported laminating film having a thickness approximately between 0.100 and 0.150 mm. The adhesive layer 30 may be a vinyl film coated on each side with an adhesive. For example, the removable layer 40 can be made from plastic, paper or another material, and have a surface that is in contact with the adhesive layer 30 that is configured for easy removal thereof when pulled by the user.

Figure 3:
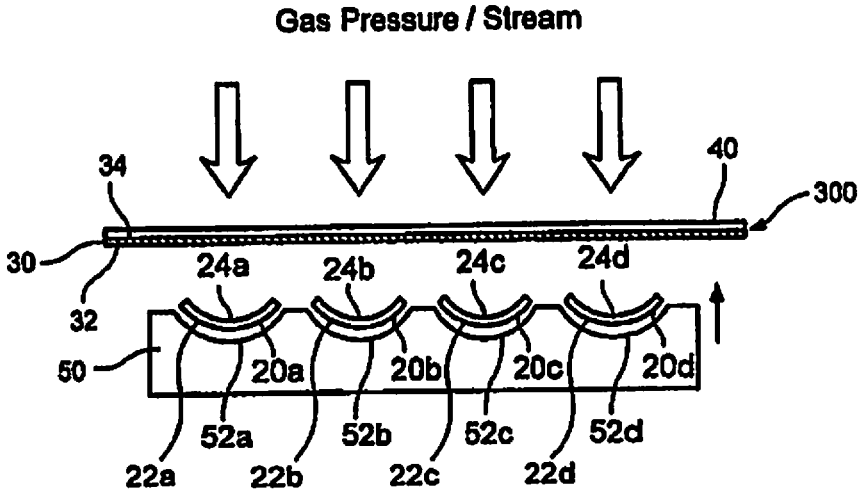
FIG. 3 is a side view of a mold for processing according to an embodiment of the present invention.

In an embodiment of the present invention, a method for making an artificial fingernail can be provided. For example, at least one polymeric body having a shape corresponding with at least a portion of a natural nail can be formed. In FIG. 3, an injection mold is illustrated which includes a mold part 50 for forming the polymeric body, i.e., four polymeric bodies 20*a*, 20*b*, 20*c*, 20*d* as shown. The mold part 50 includes at least one and preferably several cavities or well portions, i.e., four well portions 52*a*, 52*b*, 52*c*, 52*d*, as shown in FIG. 3. Each well portion 52*a*, 52*b*, 52*c*, 52*d* can have the shape, size and thickness of the respective polymeric bodies 20*a*, 20*b*, 20*c*, 20*d*. Each polymeric body 20*a*, 20*b*, 20*c*, 20*d* formed in mold part 50 has a convex surface 22*a*, 22*b*, 22*c*, 22*d* and a concave surface 24*a*, 24*b*, 24*c*, 24*d*.

After forming polymeric bodies 20*a*, 20*b*, 20*c*, 20*d*, a composite strip 300 is disposed over the polymeric bodies. The composite strip 300 can include the adhesive layer 30 having first and second layer surfaces 32, 34, respectively, and the removable layer 40. For example, the composite strip 300 can include a pressure sensitive adhesive film covered on one side with a silicon treated paper or plastic film. The first layer surface 32 faces the concave surfaces 24*a*, 24*b*, 24*c*, 24*d* of the polymeric bodies 20*a*, 20*b*, 20*c*, 20*d*. The second layer surface 34 can be covered by the removable layer 40.

According to an embodiment of the present invention, gas pressure and/or air pressure can then be directed toward the mold part 50, and specifically toward the second layer surface 34. Thus, in such manner, the first layer surface 32 of the adhesive layer 30 is pushed to contact and adhere to the concave surfaces 24*a*, 24*b*, 24*c*, 24*d* of the polymeric bodies 20*a*, 20*b*, 20*c*, 20*d*. According to another embodiment of the present invention, it is possible to utilize one or more robotic arms to press the composite strip 300 on top of the polymeric bodies 20*a*, 20*b*, 20*c*, 20*d* so that the composite strip 300 contacts these polymeric bodies 20*a*, 20*b*, 20*c*, 20*d*. Robotic arms can be controlled via a computer arrangement (e.g., a microprocessor), which can implement and/or execute software residing on a computer-accessible medium (e.g., hard disk, floppy drive, memory stick, RAM, ROM, etc.) to press the composite strip 300 on top of the polymeric bodies 20*a*, 20*b*, 20*c*, 20*d*.

Figure 4:
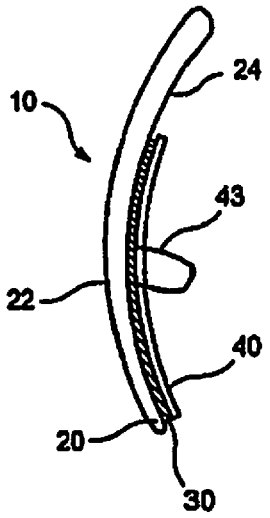
FIG. 4 is a side view of a second embodiment of the artificial fingernail of the present invention.
Figure 5:
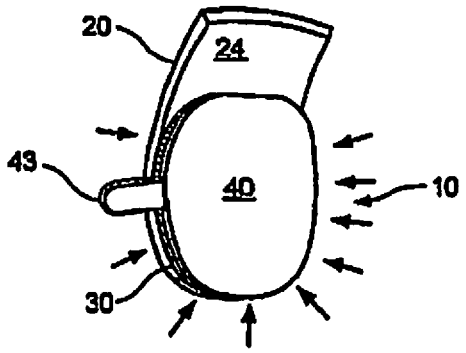
FIG. 5 is a bottom perspective view of the second embodiment of the present invention in FIG. 4.

A second embodiment of the artificial fingernail 10 is shown in FIGS. 4 and 5. All of the elements of the second embodiment illustrated in FIGS. 4 and 5 that are labeled in the same manner as those provided in the first embodiment illustrated in FIGS. 1 and 2 are the same or similar elements. The difference between the first and second embodiments is that a tab 43 is provided at a side of the polymeric body 20 and/or the artificial nail 10. In particular, according to the second embodiment of the present invention, the tab 43, which is provided for facilitating removal of the removable layer 40 from the adhesive layer 30, extends outwardly beyond the periphery of the polymeric body 20. Particularly, the tab 43 can be integrally and/or detachably connected to a right side edge of the removable layer 40, e.g., at a right side edge of the polymeric body 20.

Figure 6:
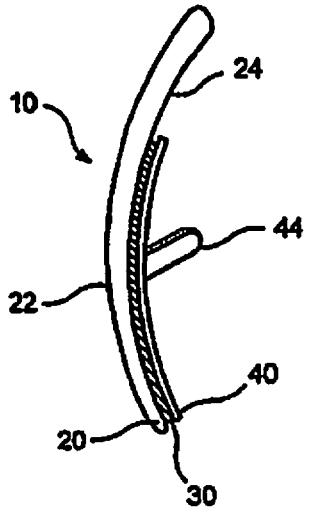
FIG. 6 is a side view of a third embodiment of the artificial fingernail of the present invention.
Figure 7:
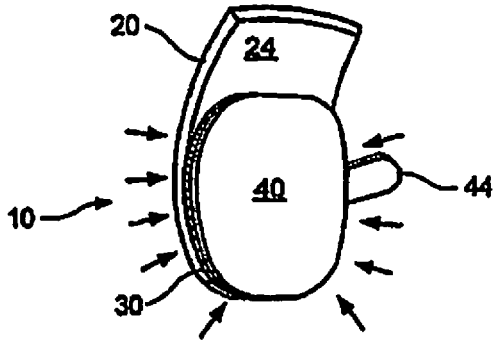
FIG. 7 is a bottom perspective view of the third embodiment of the present invention in FIG. 6.

A third embodiment of the artificial fingernail 10 is shown in FIGS. 6 and 7. All of the elements of the third embodiment provided in FIGS. 6 and 7 that are labeled in the same manner as those provided in the second embodiment illustrated in FIGS. 4 and 5 are the same or similar elements. The difference between the second and third embodiments is that a tab 44 is provided at a side of the polymeric body 20 and/or the artificial nail 10 that is opposite the side at which tab 43 was provided. In particular, the tab 44 can be integrally and/or detachably connected to a left side edge of the removable layer 40, e.g., at a left side edge of the polymeric body 20.

Figure 8:
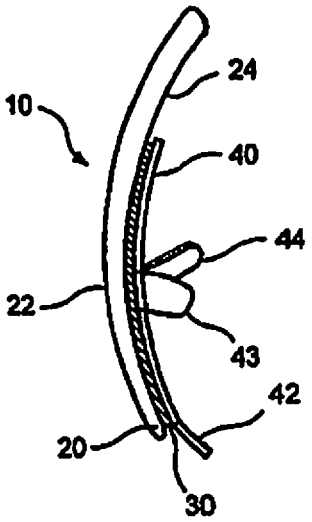
FIG. 8 is a side view of a fourth embodiment of the artificial fingernail of the present invention.
Figure 9:
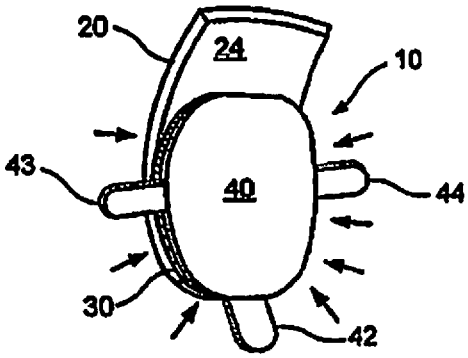
FIG. 9 is a bottom perspective view of the fourth embodiment of the present invention in FIG. 8.

A fourth embodiment of the artificial fingernail 10 is shown in FIGS. 8 and 9. All of the elements of the fourth embodiment provided in FIGS. 6 and 7 that are labeled in the same manner as those provided in the first, second and third embodiments illustrated in FIGS. 1-7 are the same or similar elements. The difference between the fourth embodiment and the first, second and third embodiments is that all three tabs 42, 43, 44 are provided at the respective sides of the polymeric body 20 and/or the artificial nail 10. Thus, the user of the artificial nail 10 can pull any one or more of the three tabs 42, 43, 44 to remove the removable layer 40 from the adhesive layer 30, so that the adhesive layer can be applied to the top surface of at least one portion of the user's natural nail.

Referring again to FIG. 3, when the gas pressure and/or air pressure is directed toward the mold part 50, specifically toward the second layer surface 34, and the first layer surface 32 of the adhesive layer 30 is pushed to contact and adhere to the concave surfaces 24*a*, 24*b*, 24*c*, 24*d* of the polymeric bodies 20*a*, 20*b*, 20*c*, 20*d*, a crease or wrinkle can form in the removable layer 40.

Accordingly, an embodiment of the artificial nail of the present invention includes the removable layer 40 having one or more slits 401. As illustrated in FIGS. 10A-10E, the slits 401 can be provided in (a) a vertical orientation; (b) a horizontal orientation; (c) a mixed horizontal and vertical orientation with the slits 401 extending to an edge 402 of the removable layer 40; (d) a radial orientation with the slits 401 extending to the edge 402 of the removable layer 40; and (e) a mixed horizontal, vertical and radial orientation.

The radial orientation of the slits 401 is preferably oriented along lines where the concave surfaces 24*a*, 24*b*, 24*c*, 24*d* exhibit the highest concavity, and is not limited to lines directed towards the center of the removable layer 40. Thus, when the adhesive layer 30 is pushed to contact and adhere to the concave surfaces 24*a*, 24*b*, 24*c*, 24*d* of the polymeric bodies 20*a*, 20*b*, 20*c*, 20*d*, the removable layer 40 will no longer crease or wrinkle due to the space and flexibility provided by the slits 401.

Figure 10A:
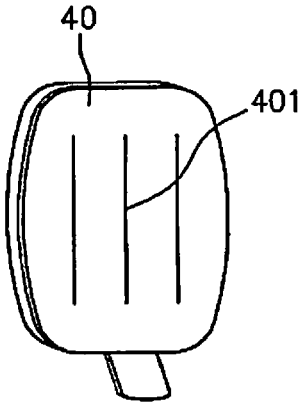
FIGS. 10A-10E are diagrams illustrating embodiments of the artificial nail of the present invention including one or more slits.
Figure 10B:
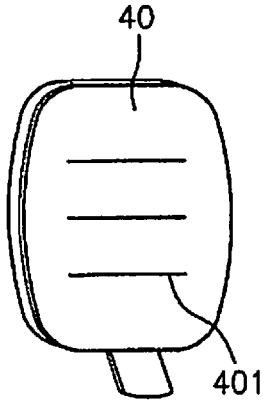
Figure 10C:
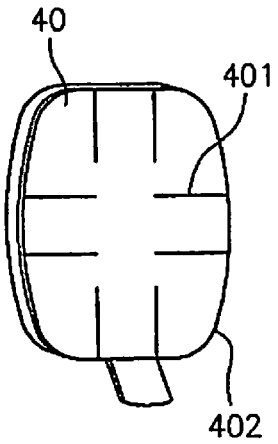
Figure 10D:
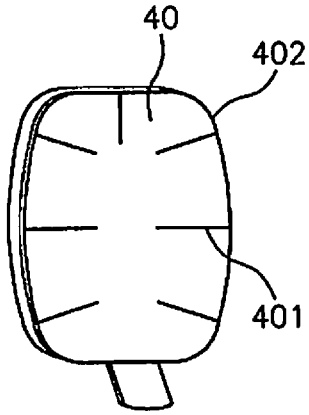
Figure 10E:
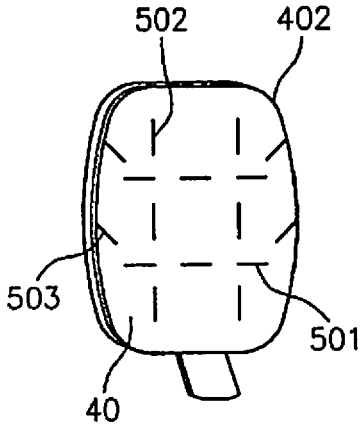

In an embodiment of the present invention shown in FIG. 10E, the combination orientation includes two sets of non-continuous horizontal slits 501, two sets of non-continuous vertical slits 502, and one or more radial slits 503 extending from the edge 402 of the removable layer 40 at an approximate 45-degree angle.

A method for manufacturing the layer 40 having the slits 401 (or 501, 502 and 503) preferably occurs through a die cutting process. A die is made according to one of the orientations described above, i.e. with slits 401 provided in a vertical, horizontal, mixed, radial, or combination orientation. Specifically, the die is shaped according to the number and orientations of the slits 401 to be cut into the removable layer 40. Prior to, or simultaneous with, the application of pressure to the composite strip 300, the slits 401 are cut in the removable layer 40 using the shaped die. As described below with respect to FIGS. 11 and 12, the slits may comprise one or more slots 411 or channels 421, which are formed by cutting a wider gap in the removable layer 40 than for the slits 401. The method for making the artificial fingernails then proceeds as described above. As a result of the die cutting process on the removable layer, slits, slots or channels may also be formed in the adhesive layer.

Figure 11:
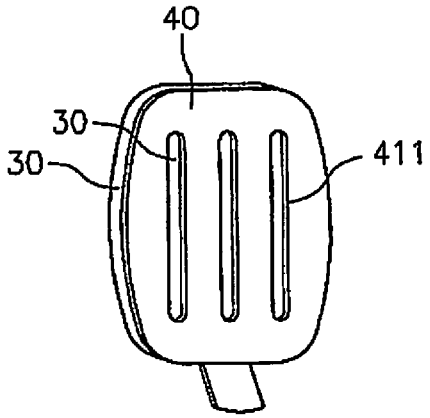
FIG. 11 illustrates an embodiment of the present invention including one or more slots.

A further embodiment of the present invention is illustrated in FIG. 11 and includes the removable layer 40 having one or more slots 411, the slots 411 being wider than the slits 401. As described above for the one or more slits 401, the slots 411 can be provided in (a) a vertical orientation, (b) a horizontal orientation, (c) a mixed horizontal and vertical orientation with the slots 411 extending to an edge 402 of the removable layer 40, (d) a radial orientation with the slots 411 extending to the edge 402 of the removable layer 40 and similar to the combination orientation shown in FIG. 10E.

The radial orientation of the slots 411 is preferably oriented along lines where the concave surfaces 24*a*, 24*b*, 24*c*, 24*d* exhibit the highest concavity, and is not limited to lines directed towards the center of the removable layer 40. Thus, when the adhesive layer 30 is pushed to contact and adhere to the concave surfaces 24*a*, 24*b*, 24*c*, 24*d* of the polymeric bodies 20*a*, 20*b*, 20*c*, 20*d*, the removable layer 40 will no longer crease or wrinkle due to the space and flexibility provided by the slots 411.

Figure 12:
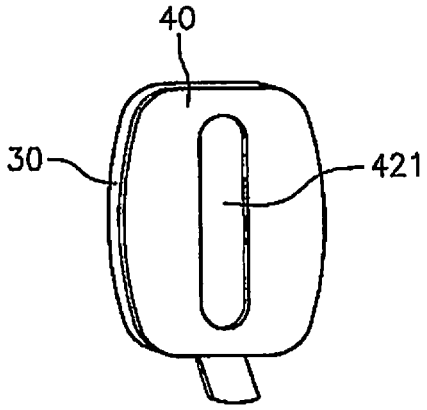
FIG. 12 illustrates an embodiment of the present invention including one or more channels.

FIG. 12 illustrates an additional preferred embodiment of the present invention and includes the removable layer 40 having one or more channels 421, the channels 421 being wider than the slots 411 and including an opening in the adhesive layer 30 and the removable layer 40. Thus, within the channels 421, the lower surface 24 of the polymeric body 20 is exposed to the user's environment.

As described above for the one or more slits 401, the channels 421 can be provided in (a) a vertical orientation, (b) a horizontal orientation, (c) a mixed horizontal and vertical orientation with the channels 421 extending to an edge 402 of the removable layer 40, (d) a radial orientation with the channels 421 extending to the edge 402 of the removable layer 40 and similar to the combination orientation shown in FIG. 10(*e*).

The radial orientation of the channels 421 is preferably oriented along lines where the concave surfaces 24*a*, 24*b*, 24*c*, 24*d* exhibit the highest concavity, and is not limited to lines directed towards the center of the removable layer 40. Thus, when the adhesive layer 30 is pushed to contact and adhere to the concave surfaces 24*a*, 24*b*, 24*c*, 24*d* of the polymeric bodies 20*a*, 20*b*, 20*c*, 20*d*, the removable layer 40 will no longer crease or wrinkle due to the space and flexibility provided by the channels 421.

While the invention has been shown and described with reference to certain embodiments thereof, it will be understood by those skilled in the art that various changes in form and details may be made therein without departing from the spirit and scope of the invention as defined by the appended claims.

What is claimed is:

1. An artificial nail or tip arrangement comprising:

a body having a concave lower surface with a shape corresponding to a shape of at least one portion of a natural nail;

an adhesive layer having a first surface and an opposing second surface, wherein the first surface adheres to at least one portion of the concave lower surface of the body and the second surface is provided to adhere to the at least one portion of the natural nail when applied thereto; and a removable layer that covers at least one portion of the second surface of the adhesive layer, and which is removable to expose the at least one portion of the second surface of the adhesive layer for application to the at least one portion of the natural nail, the removable layer comprising at least one linear slit not intersecting another slit and formed therethrough, the at least one linear slit disposed along a planar surface of the removable layer and away from an outer edge of the removable layer, wherein the at least one slit is configured to facilitate conformance of the planar surface of the removable layer to the concave lower surface of the body without wrinkling the removable layer after adherence of the first surface of the adhesive layer with the concave lower surface of the body.

2. The artificial nail or tip arrangement according to claim 1, wherein the at least one slit is oriented vertically along a length of the body.

3. The artificial nail or tip arrangement according to claim 1, wherein the at least one slit is oriented horizontally across a width of the body.

4. The artificial nail or tip arrangement according to claim 1, wherein the at least one slit comprises a plurality of slits that extend vertically along a length of the body and horizontally across a width of the body.

5. A method of making an artificial nail or a nail tip comprising the steps of:

providing a body having a shape corresponding to at least one portion of the artificial nail or the nail tip, a convex surface and a concave surface;

disposing a composite strip over the body, wherein the composite strip comprises a removable layer and an adhesive layer having a first surface and second surface, the first surface faces the concave surface of the body, and the second surface is covered by the removable layer;

forming at least one linear slit in the removable layer, the at least one slit not intersecting another slit and being disposed away from an outer edge of the removable layer;

applying a pressure to the composite strip so as to adhere at least one portion of the adhesive layer to the concave surface of the body; and reducing or eliminating the application of the pressure to the portion of the composite strip which adhered to the concave surface of the body, wherein the at least one slit is configured to facilitate conformance of the planar surface of the removable layer to the concave surface of the body without wrinkling the removable layer after adherence of the composite strip to the concave surface of the body.

6. The method according to claim 5, wherein the at least one slit is oriented vertically along a length of the body.

7. The method according to claim 5, wherein the at least one slit is oriented horizontally across a width of the body.

8. The method according to claim 5, wherein the at least one slit comprises a plurality of slits that extend vertically along a length of the body and horizontally across a width of the body.

9. An artificial nail or tip arrangement comprising:

a body having a concave lower surface with a shape corresponding to a shape of at least one portion of a natural nail;

an adhesive layer having a first surface and an opposing second surface, wherein the first surface adheres to at least one portion of the concave lower surface of the body and the second surface is provided to adhere to the at least one portion of the natural nail when applied thereto; and a removable layer that covers at least one portion of the second surface of the adhesive layer, and which is removable to expose the at least one portion of the second surface of the adhesive layer for application to the at least one portion of the natural nail, the removable layer comprising at least one tab that extends outwardly outside a periphery of the body, and at least one linear slit not intersecting another slit and formed therethrough, the at least one linear slit disposed along a planar surface of the removable layer and away from an outer edge of the removable layer, wherein the at least one slit is configured to facilitate conformance of the planar surface of the removable layer to the concave lower surface of the body without wrinkling the removable layer after adherence of the first surface of the adhesive layer with the concave lower surface of the body.

10. The artificial nail or tip arrangement according to claim 1, wherein the removable layer further comprises a plurality of angled slits formed therethrough and disposed along a planar surface of the removable layer, at least two of the plurality of angled slits being formed at non-perpendicular angles with respect to a longitudinal axis of the body, and the angles of the at least two of the plurality of angled slits being different from each other, wherein the plurality of angled slits are configured to facilitate conformance of the planar surface of the removable layer to the concave lower surface of the body without wrinkling the removable layer after adherence of the first surface of the adhesive layer with the concave lower surface of the body.

11. The artificial nail or tip arrangement according to claim 9, wherein the removable layer further comprises a plurality of angled slits formed therethrough and disposed along a planar surface of the removable layer, at least two of the plurality of angled slits being formed at non-perpendicular angles with respect to a longitudinal axis of the body, and the angles of the at least two of the plurality of angled slits being different from each other, wherein the plurality of angled slits are configured to facilitate conformance of the planar surface of the removable layer to the concave lower surface of the body without wrinkling the removable layer after adherence of the first surface of the adhesive layer with the concave lower surface of the body.

12. The artificial nail or tip arrangement according to claim 1, wherein the at least one linear slit is disposed along a line where the concave lower surface exhibits the highest concavity.

13. The method according to claim 5, wherein the at least one linear slit is disposed along a line wherein the concave surface exhibits the highest concavity.

14. The artificial nail or tip arrangement according to claim 9, wherein the at least one linear slit is disposed along a line where the concave lower surface exhibits the highest concavity.

15. The artificial nail or tip arrangement according to claim 9, wherein the body has a cuticle end for application proximate to a cuticle of the natural nail and a nail tip end opposite the cuticle end, and wherein the at least one tab comprises a plurality of tabs extending from the outer edges of the removable layer that are positioned away from the cuticle end.

16. The artificial nail or tip arrangement according to claim 9, wherein the tab is adapted to be bent under the concave lower surface and unbent to extend outwardly outside the periphery of the body.

* * * * *